United States Patent [19]

Smith et al.

[11] 4,121,745

[45] Oct. 24, 1978

[54] ELECTRO-MECHANICAL IMPACT DEVICE

[75] Inventors: James E. Smith, Boulder, Colo.; Carl T. Becht, Cincinnati, Ohio

[73] Assignee: Senco Products, Inc., Cincinnati, Ohio

[21] Appl. No.: 810,903

[22] Filed: Jun. 28, 1977

[51] Int. Cl.[2] ..... B25C 1/06

[52] U.S. Cl. ..... 227/8; 227/131; 173/13

[58] Field of Search ..... 227/7, 8, 79, 80, 110, 227/111, 129, 131, 133; 173/13, 124; 254/30; 83/572, 573, 627; 30/362, 366

[56] References Cited

U.S. PATENT DOCUMENTS

| | | | |
|---|---|---|---|
| 2,593,186 | 4/1952 | Richardson | 173/124 |
| 3,149,412 | 9/1964 | Carfman et al. | 254/30 |
| 3,376,933 | 4/1968 | Burlett | 254/30 |
| 4,042,036 | 8/1977 | Smith et al. | 227/131 |

*Primary Examiner*—Granville Y. Custer, Jr.
*Attorney, Agent, or Firm*—Melville, Strasser, Foster & Hoffman

[57] ABSTRACT

An electro-mechanical impact device, useful for driving nails, staples and other fastening elements. The driving member is driven by frictional engagement between a pair of counter-rotating high speed flywheels. The device has a safety provision whereby it cannot be actuated until the nose of the device is pressed against a work piece. This action also produces a movement of one of the flywheels toward the other. Actuation of the trigger moves the driving member into engagement between the counter-rotating flywheels, and these propel the driving element in a fastener driving direction. The inertia of the movable flywheel aids in efficient engagement of the flywheels with the driving member, and the movable flywheel is provided with a leaf spring permitting it to yield so that the driving member can pass between the flywheels while maintaining frictional engagement between the flywheels and the driving member. The driver is connected to an elastic member, so that when the tool is lifted from the work, the movable flywheel is moved away from the fixed flywheel, and the elastic member then retracts the driving member between the flywheels to a position out of contact therewith. The two flywheels are driven in synchronism by a single electric motor.

30 Claims, 11 Drawing Figures

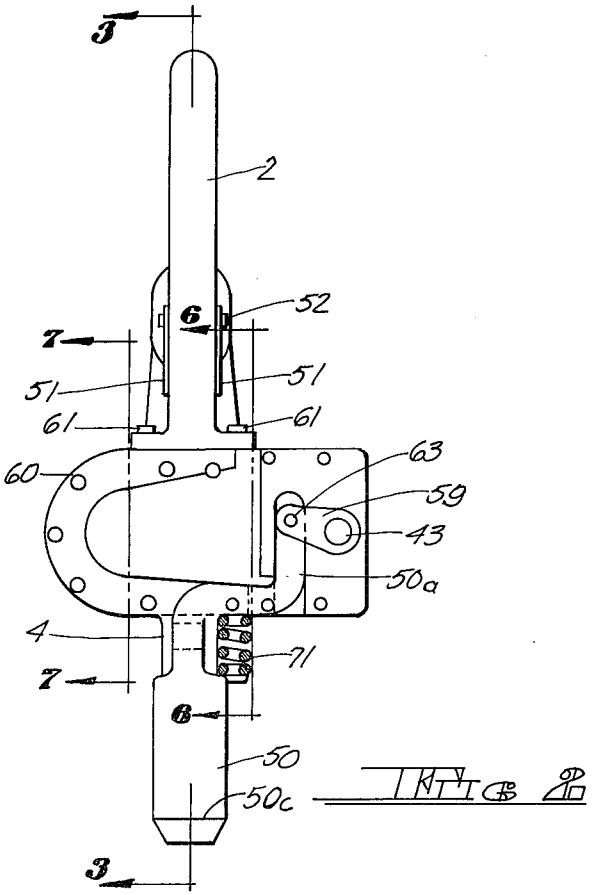
FIG. 8
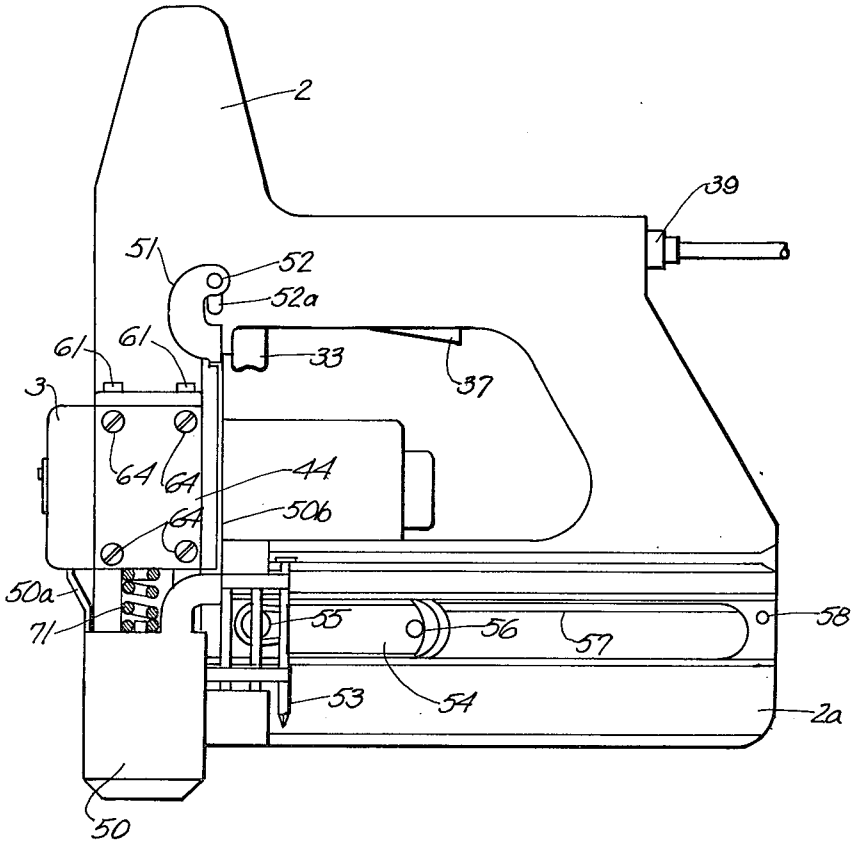
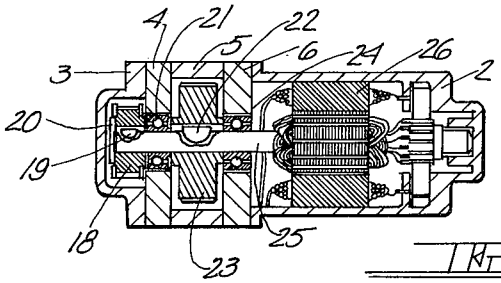
FIG. 7
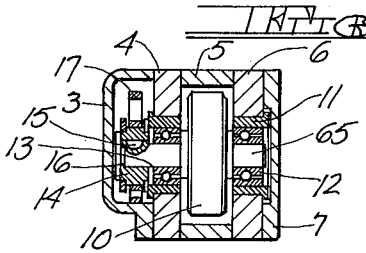
FIG. 11
FIG. 10

ELECTRO-MECHANICAL IMPACT DEVICE

CROSS REFERENCE TO RELATED APPLICATION

This application discloses and claims improvements over the disclosure of Ser. No. 580,246 filed May 23, 1975, in the names of James E. Smith et al, now U.S. Pat. No. 4,042,036 issued Aug. 16, 1977.

BRIEF SUMMARY OF THE INVENTION

Powered nailers and staplers have come into widespread use by virtue of the fact that they are capable of more rapidly and more precisely driving fasteners than can be accomplished by manual fastener driving. Such power devices have been largely pneumatic; but this has necessitated the presence of a source of compressed air, and long, relatively heavy hoses. On a construction job, it was necessary to have a portable air compressor; and for work on the roof of a house, or an upper story, the air hoses had to be quite long, because the compressor usually remained on the ground.

It is therefore desirable to provide an electric powered nailer or stapler, which will only require a source of electrical energy. Electricity is always present at a construction site so as to permit the use of electric drills, electric power saws, and the like. An electrically powered tool would also be desirable for use in the home, where compressed air is usually not available but electricity is.

The above mentioned application discloses an electrically powered device which can drive a sixteen penny nail into semi-hard wood, but the tool is subject to a number of limitations.

The electric impact device disclosed in Ser. No. 580,246 uses a clutch that depends upon translation of at least one of two flywheels toward a ram suspended between the two flywheels, thereby pinching the ram between the flywheels and propelling it. The static analysis of the clutch system provided in Ser. No. 580,246 shows that the ram will not slip on the flywheel surfaces if the coefficient of friction $K_f$ between the ram and the flywheel is greater than or equal to tan $\theta$ where $\theta$ is the suspension angle of the translating flywheel.

A dynamic analysis of this sytem shows, however, that compensation for rapid changes in the required drive force require large annular accelerations of the pivoting flywheel assembly about the suspension axis. Considering drive strokes on the order of 1 millisecond and relatively large flywheel assembly inertia, it can be shown that the friction force required for angular acceleration of the flywheel assembly may easily be an order of magnitude greater than that required to drive a large fastener. In other words, the inertia of the flywheel about the suspension axis inhibits effective clutch engagement and clutch efficiency. Efficient clutch action is essential to the practicality of the tool. Inefficient clutch action wastes energy which must be made up through larger and heavier flywheels and motors, rendering the tool less desirable for the hand held use for which it is intended. Additionally, such a tool should be capable of driving fasteners in rapid succession, and energy loss through inefficienty means more time is required for energy buildup in flywheels between work strokes. As an example, a particular tool built according to the teachings of U.S. Pat. No. 4,042,036 weighs about 22 pounds, and is capable of driving nails at a rate of only one every three seconds. That particular tool is equipped with two electric motors, which can lead to additional clutch inefficiencies resulting from non-synchronized flywheels.

The tool according to the present invention overcomes the objections mentioned above. It employs two counter-rotating flywheels as in said copending application, but they are driven in synchronism by a single electric motor. One of the flywheels is fixed and the other is movable and normally biased away from the fixed flywheel. The two flywheels are driven by a belt permitting relative motion between the driving and driven pulleys without loss of synchronization. For actuation the movable flywheel is caused to approach the fixed flywheel, so that the space between the flywheels is narrower than the thickness of the driver element. The drive is then achieved by introducing the driver element between the rotating, closely spaced flywheels. The inertia of the flywheels opposes their separation upon introduction of the driver element, and therefore assists in efficient engagement of the flywheels and driver element. A leaf spring permits the movable flywheel to yield a small amount to accommodate the driver element between the flywheels, while maintaining frictional drive between the flywheels and the driver element.

A safety is provided, which, upon contacting the work piece, moves the movable flywheel from inoperative to operative position, and frees the trigger for manual actuation. When the tool is removed from contact with the work, the movable flywheel returns to its inoperative position. The driver element is maintained out of contact with the flywheels by an elastic member, and is moved into contact with the flywheels by actuation of the trigger.

It should be pointed out that the flywheel inertia opposing separation of the flywheels upon introduction of the driver element between them causes very large nominal forces to be exerted on the driver element so that, even with low friction coefficients, large drive forces are possible. The use of flywheel inertia to assist clutch engagement rather than impede clutch engagement as is the case of the tool built according to the teachings of Ser. No. 580,246, results in higher clutch efficiency. As a result, prototype tools have been built according to the teachings of this application which are much lighter and capable of much more rapid drive cycling than the tool built in accordance with the teachings of U.S. Pat. No. 4,042,036.

BRIEF DESCRIPTION OF THE SEVERAL FIGURES OF THE DRAWING

FIG. 1 is a side elevational view of a tool according to the present invention.

FIG. 2 is a front elevational view thereof as seen from the left of FIG. 1.

FIG. 6 is a fragmentary cross sectional view taken on the line 6—6 of FIG. 2.

FIG. 7 is a fragmentary cross sectional view taken on the line 7—7 of FIG. 2.

DETAILED DESCRIPTION

Figures 3, 4, 5:
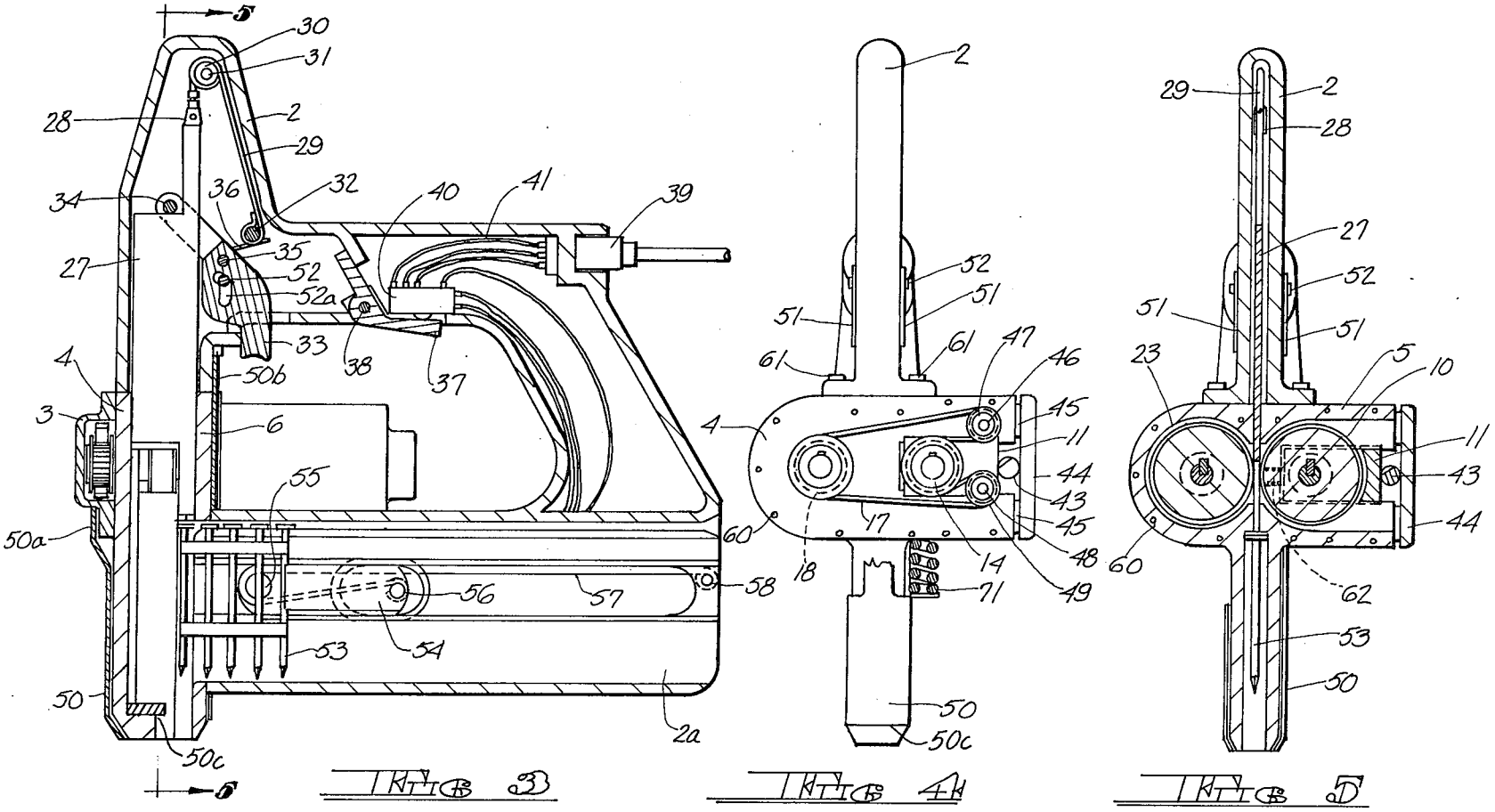
FIG. 3 is a cross sectional view taken on the line 3—3 of FIG. 2.
FIG. 4 is a front elevational view of FIG. 3 with the cover housing 3 removed.
FIG. 5 is a cross sectional view taken on the line 5—5 of FIG. 3.

The device of the present invention will be described as a device for driving nails. It should be understood, however, that it may be utilized for driving any other type of fastening elements or for any purpose requiring high velocity impact.

The main housing of the tool is designated at 2 and it includes a section serving for a nail magazine designated at *2a*. The flywheel housing is indicated at 5 (best seen in FIGS. 4, 5, 6, and 7) and it is disposed between the bearing support plates 4 and 6. These bearing support plates also provide guide means for the driver element 27 (see FIGS. *3a*, 5 and 8). The housing 5 and the bearing plates 4 and 6 are fastened together by means of screws 60 and the flywheel housing and main housing are secured together by screws 61.

Figure 8:
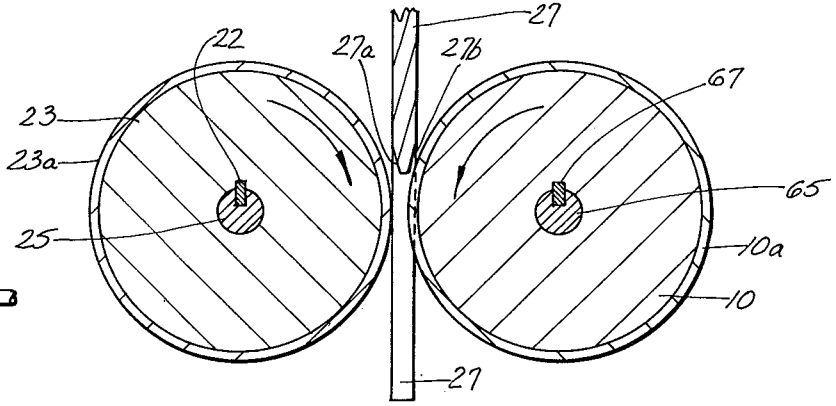
FIG. 8 is an enlarged fragmentary cross sectional view showing the driver element and the counter-rotating flywheels just prior to engaging the driver element.

The two flywheels as best seen in FIG. 8 are indicated at 23 and 10. The flywheel 23 is keyed to the rotor shaft 25 at 22 while the stator 26 of the motor and other components of the motor are mounted in the main housing 2 as best seen in FIG. 7. The rotor shaft 25 is supported in the bearing plate 6 by means of the bearing 24 and in the bearing plate 4 by means of the bearing 21. A gear belt pulley 18 is keyed to the shaft 25 as at 19 and is retained in position by the thrust plate 20.

The flywheel 10 is fixed on the shaft 65 with a key 67, in a manner similar to the flywheel 23. The shaft 65 is mounted in the bearing clevis 11 by means of bearings 12 and 13. A gear belt pulley 14 is mounted on the end of the shaft 65 and keyed thereto as at 15. Again, a thrust plate 16 serves to retain the gear belt pulley on the shaft 65.

Figure 3A:
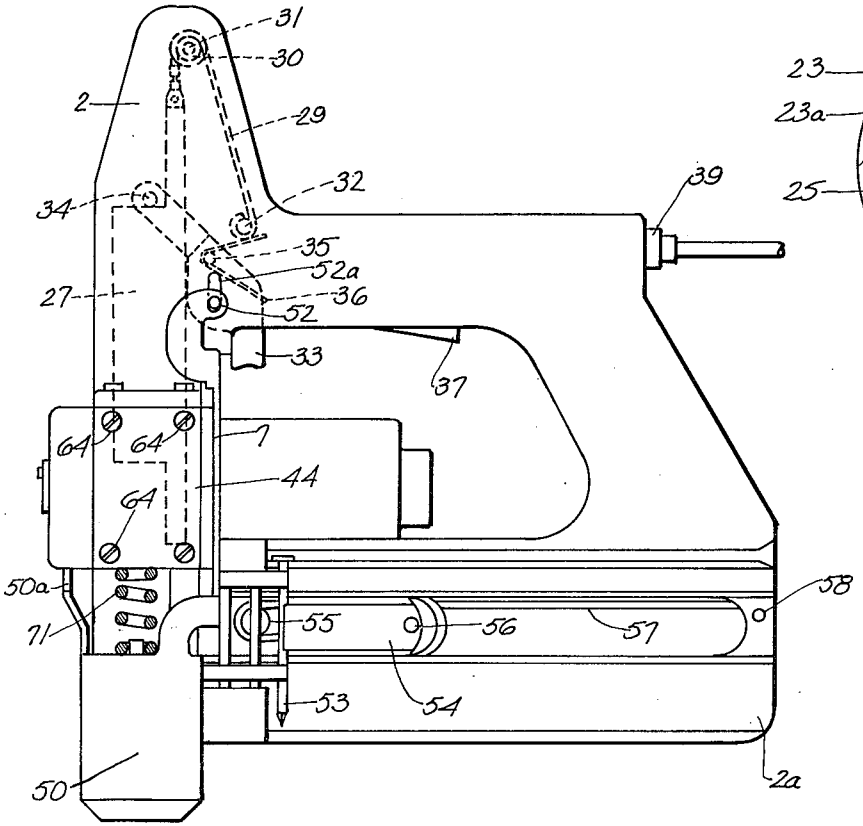
FIG. 3A is a view similar to FIG. 1 showing the tool in the position out of contact with the work and the safety in position to prevent actuation of the trigger.

The bearing clevis 11 which carries the flywheel 10 is perhaps best seen in FIGS. 4, 5, 9 and 10. The clevis 11 is constantly biased away from the flywheel 23 by means of springs 62 (FIG. 5). A spring plate 44 is attached to the bearing plates 4 and 6 by means of screws 64 (FIGS. 1 and 3A).

The mounting of the flywheel 10 in the clevis 11 makes it possible to cause the flywheel 10 to approach and move away from the flywheel 23. As indicated above, the springs 62 continuously bias the clevis and therefore the flywheel 10 away from the flywheel 23. A cam rod 43 is mounted in the cover housing 3 and the cover plate 7 so as to abut the spring plate 44 and the end surface of the bearing clevis 11. The cam rod, as clearly seen in FIGS. 9 and 10, has a flat so that when the flat is turned toward the bearing clevis 11, the bearing clevis is permitted to move slightly toward the right. When the rod 43 is turned to the position of FIG. 9, the bearing clevis is moved toward the left to bring the flywheel 10 closer to the flywheel 23. The spacing is such that in the position of FIG. 9 the peripheries of the flywheels 10 and 23 are spaced apart a distance slightly less than the thickness of the driver element 27. Pressure is maintained on the driver element 27 by means of the spring plate 44 which permits the flywheel 10 to move slightly away from the flywheel 23 to accommodate the thickness of the driver element 27; but by virtue of the spring plate 44 pressure is maintained on the driver element. The spring plate, as best seen in FIGS. 3A, 9 and 10, is mounted to the bearing plates 4 and 6 by means of screws 64 and with the spacers 45.

One end of the cam rod 43 is mounted in the cover housing 3 and is equipped with a lever 59 (FIG. 2). This lever is operatively connected to the safety element 50 which operates by contact with the work piece. The lever 59 is secured to the safety 50 by means of the pin 63. The safety 50 has a portion **50*a* (FIG. 2) at the front of the tool and the portion 50*b* (FIG. 1) extending up the sides of the tool. The portion 50*b* is secured to the ears 51** for a purpose which will be described hereinafter.

Figure 9:
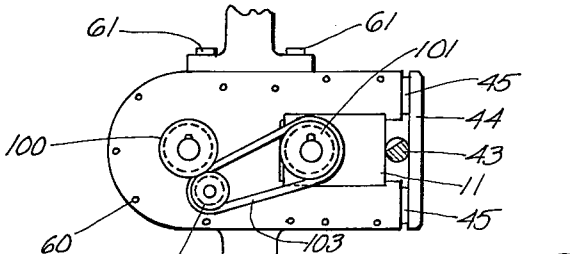
FIG. 9 is a front elevational view similar to FIG. 4 showing an alternate drive system for the counter-rotating flywheels.
Figure 10:
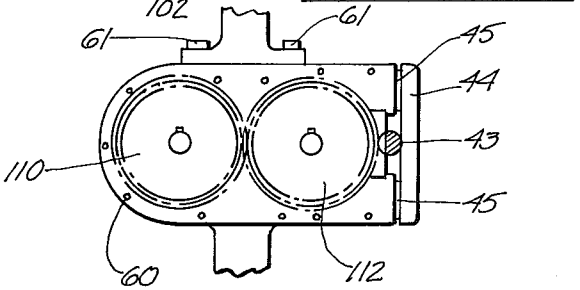
FIG. 10 is a view similar to FIG. 9 showing yet another alternative drive system for the counter-rotating flywheels.

From the foregoing description, it will be clear that when the tool is pressed against the work (FIGS. 1 and 3) the lever 59 will be rotated clockwise (FIG. 2) to bring cam rod 43 to the position shown in FIG. 9 in which the flywheel 10 is brought into operative position. When the tool is lifted from the work piece, the safety element 50 returns, as a result of spring 71, to the position in FIG. 3A in which the lever 59 rotates the cam rod to the position of FIG. 10, thereby permitting the flywheel 10 to move back to inoperative position.

The driver element or impact ram 27 is mounted in and guided between the bearing plates 4 and 6. At its upper end it is connected by means of a clevis 28 to an elastomeric means 29. The member 29 is guided over a pulley 30 mounted on the pin 31 and secured by a pin 32 at its remote end. This structure maintains the driver element or impact ram in its uppermost position (FIG. 3 and FIG. 8). It should be pointed out that, while elastomeric means 29 is utilized in the preferred embodiment of this invention, other drive element returns and retention means are recognized, and could be used without departing from the spirit of the invention. A manual trigger is provided at 33 which is mounted by means of a pin 35 and pivots about the pin 35. The trigger is biased to inoperative position by a torsion spring 36. A pin 34 running through the clevis end of the manual trigger 33 rests upon the ram or driver element 27. As seen in FIG. 8, in the at rest position the member 27 is out of contact with the flywheels 10 and 23 and when the trigger is actuated, the rocking of the trigger transmits the action by means of the pin 34 to start the ram 27 downward to the point where it is engaged between the flywheels 10 and 23.

Slots **52*a* are provided in the main housing 2 and a safety pin 52 passes through the trigger 33 and through the slots 52*a*. On the outside of the housing 2 the safety pin 52 is connected to the safety clevis 51 mentioned above. This straddles the main housing 2 and is connected to the work piece responsive safety 50 by portion 50*b*. From a consideration of FIGS. 3 and 3A, it wll be observed that in the idle position with the tool out of contact with the work piece the trigger cannot be pivoted about the point 35 because the pin 52 is confined in the lower portion of slot 52*a* and also in the lower portion of the corresponding slot in trigger 33. However, at the top of the slot in trigger 33 there is an offset best seen in FIG. 3, so that when the safety 50 is pressed against the work, the pin 52 is moved to the top of the slot 52*a* and the top of the corresponding trigger slot and the small offset permits the trigger to be actuated and thus to start the impact element 27** on its downward path.

Electrical energy is provided by means of an extension cord 39. This is connected to a suitable switch 40 by means of the wires 41. The switch 40 is normally off so as to prevent flow of current to the motor. Adjacent to the switch 40 the housing 2 is provided with a "dead man" trigger 37 mounted on a pin 38. Thus, when the device is held in the hand as it normally would be gripped, the dead man trigger 37 will actuate the switch 40 and provide electrical energy for the motor. As soon as the device is released, however, the dead man trigger 37 returns to its normal position and de-activates the switch 40.

There are a number of ways in which a single motor may be caused to drive the two flywheels counter-rotatively. The preferred form is seen in FIG. 4. In this embodiment, the flywheel 23 is powered directly from the shaft 25 on which the rotor of the motor is mounted. A double faced gear belt 17 cooperating with the pulley 18, the idler pulley 47, the pulley 14, and the idler pulley 49, rotates the pulleys 14 and 18 in opposite directions and therefore the flywheels 10 and 23. The idler pulley 49 is mounted on a shaft 48 which, in turn, is mounted on the bearing clevis 11. This arrangement permits the bearing clevis 11 and the flywheel 10 to move toward and away from the flywheel 23 without disengaging the gear belt teeth. Although not described in detail herein or shown in the drawings, well accepted industry practice dictates that either idler pulley 47 or idler pulley 49 be resiliently mounted to compensate for variations in belt lengths, belt wear, etc., as well as to compensate for slight changes in belt path length resulting from flywheel translation.

An alternate arrangement is shown in FIG. 9. Here an elastomeric member 103, as for example an O-ring cooperating with the idler pulley 102, is in frictional engagement with the pulley 100. The rotation of the pulley 101 thus produces rotation of the pulley 100 in the opposite direction and again provides for counter-rotation of the flywheels. In this embodiment, the movement of the bearing clevis 11 and flywheel 10 toward and away from the flywheel 23 is accommodated by stretching or retraction of the elastomeric member 103.

Another alternative arrangement is shown in FIG. 10 where spur gears 110 and 112 are mounted on the respective shafts. This arrangement obviously produces counter-rotating flywheels. The disadvantage of this structure, however, is that noise and lubrication to reduce wear become problems at the higher rpm involved. The bearing clevis 11 and flywheel 10 can move with respect to the flywheel 23 while gears 110 and 112 remain engaged.

As indicated heretofore, the lower portion of the main housing indicated at *2a* is adapted to hold a strip of nails 53. The strip of nails is urged into position to be driven by means of a feeder 54 which is urged forward by the elastomeric member 57. The member 57 is connected to the pin 56 in the feeder 54 and then passes around the roller 55 and is attached to the pin 58 at the rear of the magazine portion *2a*.

In operating the device, the extension cord 39 is plugged into the rear of the handle portion of the main housing 2. With the device in this condition, all the components would appear as they do in FIG. *3a*. In this condition the trigger 33 cannot be actuated even if the dead man trigger 37 is actuated. The bearing clevis 11 with its flywheel 10 will be at the point farthest away from the flywheel 23 or in its inoperative condition as shown in FIG. 10. It will be assumed that a strip of nails 53 has been placed in the magazine portion *2a*.

When the device is gripped around the handle portion the dead man trigger 37 is depressed so that the switch 40 is activated to provide current to the motor. The rotor shaft 25 of the motor begins to turn and therefore the flywheel 23 begins to rotate as well as the gear belt pulley 18. The double faced gear belt 17 causes the idler pulley 47, the gear belt pulley 14, the idler pulley 49 also to rotate. The gear belt pulley 14 causes the shaft 65 to rotate, thereby producing rotation of the flywheel 10 in a direction opposite to that of the flywheel 23. In a very short period of time, the two flywheels 10 and 23 will be up to the maximum rpm developed by the motor and the device is then fully energized and ready to drive nails.

If the operator now presses the work piece responsive safety 50 against the material into which the nail is to be driven, the pin 63 causes the lever 59 to be rotated in a clockwise direction as heretofore described. This produces rotation of the cam rod 43 from the position of FIG. 10 to the position of FIG. 9, thereby moving bearing clevis 11 and the flywheel 10 supported thereon toward the flywheel 23. At the same time, the safety clevis 51 moves upward and carries the pin 52 with it. When the work piece responsive safety has been moved to its furthermost position, the distance between the peripheries of the flywheels 10 and 23 will be less than the thickness of the impact ram 27 and the safety pin 52 will have been moved to a position where the manual trigger 33 may be operated as heretofore described.

When the operator squeezes the manual trigger 33 whereby it is caused to rotate about the pin 35 and against the pressure of the torsion spring 36, the pin 34 contacts the upper surface of the impact ram and moves it downward toward the flywheels 10 and 23, thereby also slightly extending the elastomeric member 29.

As best seen in FIG. 8, the flywheels 10 and 23 are coated with a material having a relatively high dynamic coefficient of friction as indicated at *10a* and *23a*. This coating material is preferably a strong, dense, high modulus material such as the type which is used for aircraft brakes. As an option, the friction lining can be applied to the impact ram 27 instead of to the flywheels 10 and 23. The lower end of that portion of member 27 which is to enter between the flywheels 10 and 23, may be provided with a short taper at *27a* and *27b*. When these tapered sides of the impact ram come into contact between the rapidly rotating flywheels 10 and 23, the flywheels frictionally engage the impact ram and rapidly accelerate it to the same linear speed as the peripheral speed of the flywheels. Energy stored in the flywheels is now transferred through the impact ram 27 to the forwardmost nail in strip 53 which is driven into the material to be fastened. As the impact ram is admitted between the flywheels, flywheel 10 is forced away from fixed flywheel 23. The inertia of flywheel 10 acts to oppose that separation, and thereby aids in the frictional engagement of flywheels 10 and 23 with the impact ram. In addition, from the time the impact ram 27 contacts the flywheels until it leaves them slightly before the end of the working stroke, the movable flywheel 10 is forcibly in contact with the impact ram 27 by virtue of the spring plate 44. As the movable flywheel 10 tries to back away from the fixed flywheel 23 to admit the impact ram, the bearing clevis 11 moves with it, thereby causing the cam rod 43 to flex the spring plate 44. Slightly before the termination of the working stroke, the impact ram 27 passes beyond the flywheels 10 and 23 and a portion of the kinetic energy of the impact ram is absorbed by continued driving of the nail. The remaining kinetic energy of the impact ram is absorbed by a ram stop device, such as a bumper 50c in the nose piece of the tool, which, although not described in detail herein, is well known in the art. The working stroke is not complete.

The operator now releases the manual trigger 33 and the work piece responsive safety 50 is returned to its original position under the influence of spring 71 as the device is lifted from the work piece. As the safety returns to its original position, the pin 63 causes the lever 59 to rotate the cam rod 43 back to its original position permitting the bearing clevis 11 and its flywheel 10 to move away from the flywheel 23 under the influence of the spring 62. The space between the flywheels is now greater than the thickness of the impact ram and therefore under the influence of the elastomeric member 29 the ram returns to its original position. The return stroke is now complete and the cycle may once again be initiated.

While the tool has been described in considerable detail, it will be clear that numerous modifications may be made without departing from the spirit of the invention and no limitation which is not specifically set forth in the claims is intended and no such limitation should be implied.

The embodiments of the invention in which an exclusive property or privilege is claimed are defined as follows:

1. An impact tool comprising:

(a) an impact member;

(b) counter-rotating flywheels spaced apart by less than the thickness of the impact member;

(c) means for introducing the impact member between the flywheels; and (d) means permitting at least one of the flywheels to yield with respect to the other to permit the impact member to pass between the flywheels, while maintaining force against the impact member.

2. An impact tool according to claim 1, wherein means are provided to move selectively at least one of the flywheels from an inoperative position in which the spacing between the flywheels is wider than the thickness of the impact member, to an operative position in which the spacing between the flywheels is less than the thickness of the impact member.

3. An impact tool according to claim 2, wherein a line connecting the axes of rotation of said flywheels in the operative position of said movable flywheel is at right angles to the path of said impact member.

4. An impact tool according to claim 3, wherein said movable flywheel, in moving between its operative and inoperative positions, moves substantially along a line connecting the axes of said flywheels.

5. An impact tool according to claim 2 including means for introducing said impact member between said flywheels only after said movable flywheel is in operative position.

6. An impact tool according to claim 5 including means operative upon the movement of said movable flywheel to its inoperative position to withdraw the impact member from between the flywheels.

7. An impact tool according to claim 1 including means for rotating said flywheels in substantially synchronous counter-rotation.

8. An impact tool according to claim 7, wherein said impact member and said flywheels and said yieldable means are contained within a housing, said housing defining a drive path for said impact member.

9. An impact tool according to claim 2 including a work responsive device, said work responsive device when actuated by contact with the work, operating to move said movable flywheel to its operative position.

10. An impact tool according to claim 5 including a trigger for bringing said impact member into contact between said flywheels, and including a work responsive device preventing movement of said impact member by said trigger unless said work responsive device is pressed against the work piece.

11. An impact tool according to claim 1 wherein a portion of said impact member is tapered to facilitate its entry between said flywheels.

12. An impact tool according to claim 8 wherein each of said flywheels is mounted to a shaft and each of said shafts has a gear belt pulley keyed thereon and wherein said movable flywheel is mounted upon a movable support, an idler pulley rotatably mounted on said housing and a second idler pulley mounted on said movable support and a gear belt passing around said pulleys whereby to provide for opposite rotation of said flywheel shafts, said arrangement permitting the slight movement of said movable support between operative and inoperative positions of said flywheel without loss of synchronizing action.

13. An impact tool according to claim 8 having a drive motor in said housing, one of said flywheels being mounted on the motor shaft and having a pulley keyed thereon and the other flywheel being mounted on a shaft having a pulley keyed thereon, and an idler pulley in said housing, an elastomeric belt connecting the pulley on the flywheel shaft which is directly driven by said motor and said idler pulley, said idler pulley being spaced with respect to the pulley keyed on the other flywheel shaft such that said belt frictionally drives the flywheel on said other shaft.

14. An impact tool according to claim 8 wherein each of said flywheels is mounted on a shaft having also a spur gear keyed thereon, said spur gears being fully engaged when said movable flywheel is in the operative position but remaining in engagement throughout the movement of said movable flywheel between its operative and inoperative positions.

15. An impact tool according to claim 1 having a motor for driving said flywheels and including a "dead man" switch, said switch being open when said device is not being grasped by an operator but being closed when the device is grasped by an operator for use, said motor being energized only when said switch is closed.

16. An impact tool according to claim 1 having a magazine section for fastening elements, means for feeding said elements into position to be driven into a work piece by said impact member.

17. An impact tool according to claim 1 wherein one of said flywheels is mounted on a movable support, the means permitting said flywheel to yield with respect to the other to permit the impact member to pass between the flywheels comprises means permitting said support to move away from said other flywheel under the influence of the impact member, while maintaining force against the impact member.

18. An impact tool according to claim 1 wherein one of said flywheels is mounted on a movable support, the means permitting said flywheel to yield with respect to the other to permit the impact member to pass between the flywheels includes a cam means and a spring plate arranged to bear against said cam means, such that when said cam means has moved said movable support to operative position, wherein the spacing between said flywheels is less than the thickness of said impact member, and the entry of the impact member between said flywheels causes said movable support to move slightly, this movement is permitted by said spring plate, and said spring plate maintains pressure against said movable support during the passage of the impact member between said flywheels.

19. An impact tool comprising a main housing, a flywheel housing in which a pair of flywheels is mounted, an electric motor having a shaft and mounted on said main housing, one of said flywheels being keyed on said motor shaft, a bearing support in said main housing movable between an operative and an inoperative position, the other of said flywheels being mounted on a shaft supported in bearings on said movable support, means for driving said other flywheel from said one of said flywheels, but in the opposite direction, spring means biasing said support to the inoperative position, cam means to move said support to operative position, an impact member elastically supported in said housing out of contact with said flywheels, the spacing between the peripheries of said flywheels in the inoperative position being greater than the thickness of said impact member, and the spacing in the operative position being less than the thickness of said impact member, means to bring said impact member into contact between said flywheels when they are in the operative position, means permitting said movable support to yield to permit the impact member to enter between said flywheels while maintaining pressure against said impact member, the elastic support of said impact member serving to withdraw it from between said flywheels when said movable support is returned to inoperative position.

20. The device of claim 19, wherein a line connecting the axes of rotation of said flywheels in the operative position of said movable support is at right angles to the path of said impact member.

21. The device of claim 20, wherein said movable support, in moving between its operative and inoperative positions, moves substantially along a line connecting the axes of said flywheels.

22. The device of claim 19, wherein a work responsive device is provided, said work responsive device when actuated by contact with the work, operating said cam means to move said movable support to its operative position.

23. The device of claim 22, wherein a trigger is provided to bring said impact member into contact between said flywheels, and means associated with said work responsive device preventing movement of said impact member by said trigger unless said work responsive device is pressed against the work piece.

24. The device of claim 19, wherein a portion of said impact member is tapered to facilitate its entry between said flywheels.

25. The device of claim 19, wherein each of said flywheel shafts has a gear belt pulley keyed thereon, wherein an idler is rotatably mounted in said flywheel housing, and a second idler pulley is mounted on said movable support, and a gear belt passes around said pulleys whereby to provide for opposite rotation of said flywheel shafts, said arrangement permitting the slight movement of said movable support between operative and inoperative positions without loss of synchronizing action.

26. The device of claim 19, wherein each of said flywheel shafts has a pulley keyed thereon, and an idler pulley is provided, an elastomeric belt connecting the pulley on the flywheel shaft directly driven by said motor and said idler pulley, said idler pulley being spaced with respect to the pulley keyed on the other flywheel shaft such that said belt frictionally drives the flywheel on said other shaft.

27. The device of claim 19, wherein each of said flywheel shafts has a spur gear keyed thereon, said spur gears being fully engaged when said movable support is in the operative position, but remaining in engagement throughout the movement of said movable support between its operative and inoperative positions.

28. The device of claim 19, wherein a "dead man" switch is provided, said switch being open when said device is not being grasped by an operator, but being closed when the device is grasped by an operator for use, said motor being energized only when said switch is closed.

29. The device of claim 19 having a magazine section for fastening elements, and means for feeding said elements into position to be driven into a work piece by said impact member.

30. The device of claim 19, wherein the means permitting said movable support to yield comprises a spring plate arranged to bear against said cam means such that when said cam means has moved said movable support to operative position wherein the spacing between said flywheels is less than the thickness of said impact member and the entry of the impact member between said flywheels causes said movable support to move slightly, this movement is permitted by said spring plate and said spring plate maintains pressure against said movable support during the passage of the impact member between said flywheels.

* * * * *

UNITED STATES PATENT AND TRADEMARK OFFICE

CERTIFICATE OF CORRECTION

PATENT NO. : 4,121,745

DATED : October 24, 1978

INVENTOR(S) : James E. Smith and Carl T. Becht

It is certified that error appears in the above-identified patent and that said Letters Patent are hereby corrected as shown below:

Column 5, line 37, the numeral "101" should be -- 100 --;
same line, the numeral "100" should be -- 101 --.

Claim 13 should read as follows:

13. An impact tool according to claim 8 having a drive motor in said housing, one of said flywheels being mounted on the motor shaft and having a pulley keyed thereon and the other flywheel being mounted on a shaft having a pulley keyed thereon, and an idler pulley in said housing, an elastomeric belt connecting the pulley on the shaft which is not directly driven by said motor and said idler pulley, said idler pulley being spaced with respect to the pulley keyed on the flywheel shaft which is directly driven by said motor, such that said last named pulley frictionally drives said idler pulley, and through said belt, the pulley which is not directly driven by said motor.

UNITED STATES PATENT AND TRADEMARK OFFICE

CERTIFICATE OF CORRECTION

PATENT NO. : 4,121,745

DATED : October 24, 1978

INVENTOR(S) : James E. Smith and Carl T. Becht

It is certified that error appears in the above-identified patent and that said Letters Patent are hereby corrected as shown below:

Claim 26 should read as follows:

26. The device of claim 19 wherein each of said flywheel shafts have a pulley keyed thereon, and an idler pulley is provided, an elastomeric belt connecting the pulley on the flywheel shaft which is not directly driven by said motor and said idler pulley, said idler pulley being spaced with respect to the pulley keyed on said motor shaft such that said last named pulley frictionally drives said idler pulley, and through said belt, the pulley which is not directly driven by said motor.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,121,745

DATED : October 24, 1978

INVENTOR(S) : James E. Smith and Carl T. Becht

It is certified that error appears in the above-identified patent and that said Letters Patent are hereby corrected as shown below:

Column 5, line 37, the numeral "101" should be -- 100 --;
same line, the numeral "100" should be -- 101 --.

Claim 13 should read as follows:

13. An impact tool according to claim 8 having a drive motor in said housing, one of said flywheels being mounted on the motor shaft and having a pulley keyed thereon and the other flywheel being mounted on a shaft having a pulley keyed thereon, and an idler pulley in said housing, an elastomeric belt connecting the pulley on the shaft which is not directly driven by said motor and said idler pulley, said idler pulley being spaced with respect to the pulley keyed on the flywheel shaft which is directly driven by said motor, such that said last named pulley frictionally drives said idler pulley, and through said belt, the pulley which is not directly driven by said motor.

UNITED STATES PATENT AND TRADEMARK OFFICE

CERTIFICATE OF CORRECTION

PATENT NO. : 4,121,745

DATED : October 24, 1978

INVENTOR(S) : James E. Smith and Cart T. Becht

It is certified that error appears in the above-identified patent and that said Letters Patent are hereby corrected as shown below:

Claim 26 should read as follows:

26. The device of claim 19 wherein each of said flywheel shafts have a pulley keyed thereon, and an idler pulley is provided, an elastomeric belt connecting the pulley on the flywheel shaft which is not directly driven by said motor and said idler pulley, said idler pulley being spaced with respect to the pulley keyed on said motor shaft such that said last named pulley frictionally drives said idler pulley, and through said belt, the pulley which is not directly driven by said motor.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*